US012404634B2

(12) United States Patent
Hayden et al.

(10) Patent No.: US 12,404,634 B2
(45) Date of Patent: Sep. 2, 2025

(54) DEVICE AND METHOD FOR PRODUCING A FIBROUS WEB

(71) Applicant: Voith Patent GmbH, Heidenheim (DE)

(72) Inventors: Calvin Hayden, Sherwood, WI (US); Greg Elliott, Cincinnati, OH (US); George Graves, St Francisville, LA (US); Paul Brant, Rincon, GA (US)

(73) Assignee: Voith Patent GmbH, Heidenheim (DE)

( * ) Notice: Subject to any disclaimer, the term of this patent is extended or adjusted under 35 U.S.C. 154(b) by 146 days.

(21) Appl. No.: 18/256,248

(22) PCT Filed: Dec. 3, 2021

(86) PCT No.: PCT/EP2021/084125
§ 371 (c)(1),
(2) Date: Jun. 7, 2023

(87) PCT Pub. No.: WO2022/122576
PCT Pub. Date: Jun. 16, 2022

(65) Prior Publication Data

US 2024/0018721 A1 Jan. 18, 2024

Related U.S. Application Data

(60) Provisional application No. 63/122,225, filed on Dec. 7, 2020.

(51) Int. Cl.

| | |
|---|---|
| ***D21F 11/14*** | (2006.01) |
| ***D21F 7/08*** | (2006.01) |
| ***D21F 9/00*** | (2006.01) |

(52) U.S. Cl.
CPC ..... *D21F 11/14* (2013.01); *D21F 7/08* (2013.01); *D21F 9/003* (2013.01)

(58) Field of Classification Search
CPC ..... D21F 11/14; D21F 9/003; D21F 7/08
See application file for complete search history.

(56) References Cited

U.S. PATENT DOCUMENTS 3,537,954 A 11/1970 Justus
10,808,360 B2 * 10/2020 Anzel ..... D21F 7/083
(Continued)

FOREIGN PATENT DOCUMENTS

CN 100507121 C * 7/2009 ..... B32B 5/26
DE 102018124016 A1 11/2019
(Continued)

*Primary Examiner* — Dennis R Cordray
(74) *Attorney, Agent, or Firm* — Laurence A. Greenberg; Werner H. Stemer; Ralph E. Locher

(57) ABSTRACT

A device for producing a fibrous web, in particular a tissue web, includes a first press having a first felt and a second felt, both of which are guided through a press nip of the first press. A Yankee cylinder dries the fibrous web and a transfer press transfers the fibrous web to the Yankee cylinder. The second felt is also guided through a press nip of the transfer press. A paper-contacting side of the second felt is formed of a nonwoven layer which includes at least 80 wt. %, in particular at least 90 wt. % of nonwoven fibers formed of polyamide or polyamides and having a fineness of 6.7 dtex or less, in particular 3.3 dtex or less. An associated method for producing a fibrous web, in particular a tissue web, is also provided.

14 Claims, 2 Drawing Sheets

(56) References Cited

U.S. PATENT DOCUMENTS

| | | | | |
|---|---|---|---|---|
| 2004/0118545 | A1* | 6/2004 | Bakken | D21F 7/083 162/903 |
| 2004/0137819 | A1* | 7/2004 | Oda | D21F 7/083 442/320 |
| 2007/0068645 | A1 | 3/2007 | Silva | |
| 2017/0233946 | A1 | 8/2017 | Sealey et al. | |

FOREIGN PATENT DOCUMENTS

| | | | | | |
|---|---|---|---|---|---|
| EP | 2000587 | A1 * | 12/2008 | | D21F 1/0036 |
| KR | 20030064793 | A * | 8/2003 | | D21F 7/083 |
| WO | WO-2016022880 | A1 * | 2/2016 | | B32B 5/06 |
| WO | 2016071262 | A1 | 5/2016 | | |
| WO | 2017060053 | A1 | 4/2017 | | |
| WO | WO-2020224835 | A1 * | 11/2020 | | D21F 11/14 |

* cited by examiner

DEVICE AND METHOD FOR PRODUCING A FIBROUS WEB

FIELD AND BACKGROUND OF THE INVENTION

The invention relates to a device for producing a fibrous web, in particular a tissue web, comprising a first press, which has a first felt and a second felt, which are both guided through the press nip of the first press, and also a Yankee cylinder for drying the fibrous web and a transfer press for transferring the fibrous web to the Yankee cylinder. The invention also relates to a corresponding method for producing a fibrous web, in particular a tissue web.

For some time, there has been a trend, particularly in the tissue paper market, toward tissue papers with an even higher bulk and tissue papers which are structured. However, this market is not yet so large that it is profitable for many manufacturers to convert the entire production of a tissue machine to such high-quality products. There is therefore a desire on the part of the manufacturers of such tissue products for a flexible production plant that is capable of producing both high-quality products and standard grades with a moderate conversion effort.

Under the product name "NTT", the Valmet company offers a machine concept that promises a solution to this dilemma (https://www.valmet.com/NTT/). A central element in this "NTT" concept is that the fibrous web is pressed between a felt and an NTT belt and then transported by means of this NTT belt to a drying device in the form of a Yankee cylinder. If a structured NTT belt is used, high-quality, textured grades can be produced while, if a smooth belt is used, standard grades can be produced.

However, a disadvantage of this concept is that a comparatively expensive NTT belt must be used even for the production of simple tissue products.

SUMMARY OF THE INVENTION

It is therefore an object of the present invention to further develop the prior art in such a way that lower-cost production of tissue papers becomes possible.

In particular, it is an object of the present invention to propose an alternative to the use of the NTT belt.

These objects are fully achieved by a device for producing a fibrous web, in particular a tissue web as described below, as well as a method for producing a fibrous web, in particular a tissue web as described below.

Further advantageous embodiments of the present invention can be found in the dependent claims.

As regards the device, the object is achieved by a device for producing a fibrous web, in particular a tissue web, comprising a first press, which has a first felt and a second felt, which are both guided through the press nip of the first press, and also a Yankee cylinder for drying the fibrous web and a transfer press for transferring the fibrous web to the Yankee cylinder. According to the invention, it is envisaged here that the second felt is also guided through the press nip of the transfer press, and the paper-contacting side of the second felt consists of a nonwoven layer which comprises at least 80 wt. %, in particular at least 90 wt. %, of nonwoven fibers which consist of a polyamide or of polyamides and have a fineness of 6.7 dtex and less, in particular 3.3 dtex or less.

Thus, in the invention described here, the NTT belt is replaced by a second felt. Until now, the use of felts at this position had not been considered since it is not possible to achieve the same surface properties, in particular smoothness and impermeability to water, with felts as with the coating of NTT belts.

However, the inventors have realized that this is not necessary for the operation of the process. By virtue of the extremely high fiber fineness of the nonwoven layer of a maximum of 6.7 dtex, advantageously even 3.3 dtex or less, a comparatively dense surface is produced, so that only slight dewatering by the second felt takes place in the press nip of the first press, and instead most or all of the dewatering is performed by the first felt, as in the conventional NTT method.

Furthermore, the paper-contacting side of the second felt has a smoothness which, although below that of normal NTT belts, is significantly above that of conventional felt. In particular, such a second felt is smoother than the first felt that is likewise used in the machine. This has the effect that, after the press nip of the first press, the fibrous web adheres to the smooth surface of the second felt and not to the first felt.

Thus, while the slight disadvantages of the felt in the form of poorer smoothness and slightly higher permeability to water are acceptable when compared with the NTT belt, the use of the felt offers a number of advantages.

Among other things, it is advantageous that the polyamide fibers on the paper side of the second felt are hydrophilic, while the customary polyurethane coatings of NTT belts are hydrophobic. This hydrophilic surface reduces the re-moistening of the fibrous web on the path between the first press and the Yankee cylinder.

Various polyamides can be used for the nonwoven fibers, for example PA 6, PA 6.6, PA 10, PA 12, etc. It is also possible to envisage that the nonwoven fibers of the second felt comprise various polyamides. In particular, "bicomponent fibers" (bico fibers) can be provided, which, for example, in addition to a PA 6/PA 6.6, also comprise a low-melting PA copolymer. There are many possibilities for the felt designer when choosing the polyamide or polyamides.

However, a probably even greater advantage is the fact that such a felt is significantly less expensive than a conventional NTT belt. The same plants can be used for production as for the production of conventional felts, and the production rate is significantly higher for a felt than for a coated belt. As already mentioned, this cost advantage is a significant argument, particularly in the production of standard grade tissue paper.

In advantageous embodiments, provision can be made for the second felt also to comprise further nonwoven layers, and for at least 90 wt. % of the nonwoven fibers of all the nonwoven layers to have a fineness of 6.7 dtex and less, in particular 3.3 dtex or less. These further nonwoven layers can also be nonwoven layers which are provided on the running side of the second felt.

In particularly preferred embodiments, all the nonwoven fibers of the second felt can have finenesses of 6.7 dtex and less, in particular 3.3 dtex or less. Particular preference can also be given to all nonwoven fibers made of polyamide.

In preferred embodiments, provision can be made for the paper-contacting side of the first felt to consist of a nonwoven layer which comprises at least 80 wt. % of nonwoven fibers which have a fineness of more than 6.7 dtex, in particular 11 dtex and more. In this embodiment, reliable transfer of the fibrous web from the first felt to the second felt can be ensured without special adaptation of the first press since the differences in the surface smoothness of the two felts are large enough.

It may be advantageous if, in at least one nonwoven layer, in particular all the nonwoven layers of the second felt, at least some of the nonwoven fibers are materially bonded to one another, in particular adhesively bonded, welded or fused. Since the nonwoven fibers on the surface of the second felt are very fine, there is a risk that these fibers or parts thereof will become detached from the nonwoven layer during the operation of the device, and this can lead to accelerated wear of the felt. By the material bonding of nonwoven fibers, this wear can be counteracted, making it possible to increase the service life of the felts.

One possibility of obtaining these bonds is the addition of bicomponent fibers ("bico fibers") to the nonwoven layer, the sheath of which consists of an easily fusible polymer (preferably a PA copolymer), making it possible, with suitable heating and, if appropriate, a suitable pressure, to produce the bonds between fibers.

In advantageous embodiments, provision can be made for a large proportion of the nonwoven fibers or at least of the nonwoven layer of the paper-contacting side of the second felt to consist of bico fibers. Thus, for example, more than 25 wt. %, in particular between 30 wt. % and 60 wt. %, preferably between 49 wt. % and 50 wt. %, of the nonwoven fibers of one layer or of all the layers can consist of bico fibers.

As an alternative or in addition, however, nonwoven fibers can also be bonded in a different way, being welded for example. Transmission welding using a proportion of absorbent fibers is an advantageous method for producing such welded joints.

In order to keep the dewatering of the fibrous web by the second felt as low as possible, it can be advantageous if the second felt has an air permeability of less than 5 cfm (approximately 142 l/min), in particular of 0 cfm. In order to achieve these low values, the provision of large proportions of bico fibers as described above is very helpful, for example.

In the first press, significant dewatering of the fibrous web takes place. It is advantageous if the first press is designed as a shoe press. In contrast, the main function of the transfer press is to ensure the transfer of the fibrous web from the second felt to the surface of the Yankee cylinder. Here, a complicated shoe press—although possible—is not necessary and does not make economic sense. A simple roll nip is usually sufficient for the transfer press.

As regards the method, the object is achieved by a method for producing a fibrous web, in particular a tissue web, comprising the following steps

- transporting the fibrous web on a first felt to a first press
- pressing the fibrous web in the first press between the first felt and a second felt
- transporting the fibrous web with the second felt from the first press to a Yankee cylinder
- transferring the fibrous web from the second felt to the Yankee cylinder by means of a transfer press, wherein the second felt is also guided through the press nip of the transfer press, and the paper-contacting side of the second felt consists of a nonwoven layer which comprises at least 80 wt. %, in particular at least 90% wt. %, of nonwoven fibers which consist of polyamide or polyamides and have a fineness of 6.7 dtex and less, in particular 3.3 dtex or less.

The pressing in the first press—which, in particular, can be embodied as a shoe press—can advantageously be carried out at more than 200 kN/m, in particular between 400 kN/m and 600 kN/m.

The invention is explained below by means of schematic figures; however, the invention is not limited to the examples shown here.

DETAILED DESCRIPTION OF THE INVENTION

Figure 1:
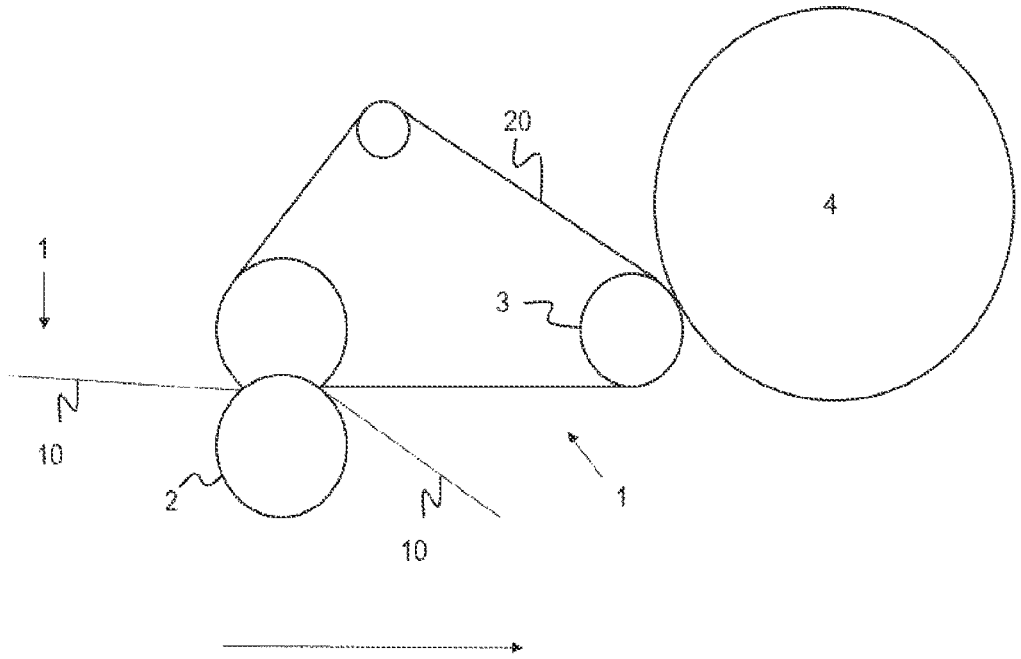
FIG. 1 shows a detail of a device according to one aspect of the invention

FIG. 1 shows the part of a device for producing a fibrous web 1 that is important for the present invention. Here, the fibrous web 1 is transported to the first press 20 while being supported on a first felt 10. In this case, it is not essential to the present invention whether the fibrous web 1 has been formed on the first felt 10 or whether it has been transferred to the first felt 10 after forming. The first press 2 is illustrated by way of example in FIG. 1 as a shoe press. The web passes through the press nip of the first press 2 in a sandwich between the first felt 10 and a second felt 20 and is dewatered as it does so. Common press loads in this context are above 200 kN/m, often between 400 kN/m and 600 kN/m. Here, the paper-contacting side of the second felt 20 consists of a nonwoven layer which comprises at least 80 wt. %, often also 100%, of nonwoven fibers which consist of a polyamide or polyamides and have a fineness of 6.7 dtex and less, in particular 3.3 dtex or less.

After leaving the press nip of the first press 2, the fibrous web 1—in particular a thin tissue web 1—does not adhere to the first felt 10 but to the second felt 20. This is due to the surface of the second felt 20, which is comparatively smooth for a felt. In the example shown in FIG. 1, the fibrous web 1 then hangs below the second felt 20. In this way, it is transported onward in the direction of the Yankee cylinder 4. The transfer from the second felt 20 to the Yankee cylinder 4 is accomplished by means of a transfer press 3. This transfer press 3 does not have any significant dewatering tasks. It is intended principally to press the second felt 20 with the fibrous web 1 against the Yankee cylinder 4 with comparatively slight pressure, ensuring that the fibrous web 1 travels along with the highly smooth surface of the Yankee cylinder 4 and is dried further there by the action of heat.

In the schematic illustration of FIG. 1, the depiction of components which are not essential for understanding the concept has been dispensed with. In practical applications, a large number of further units can also be provided, in particular cleaning devices such as, for example, scrapers, felt conditioners, sensors or the like.

Figure 2:
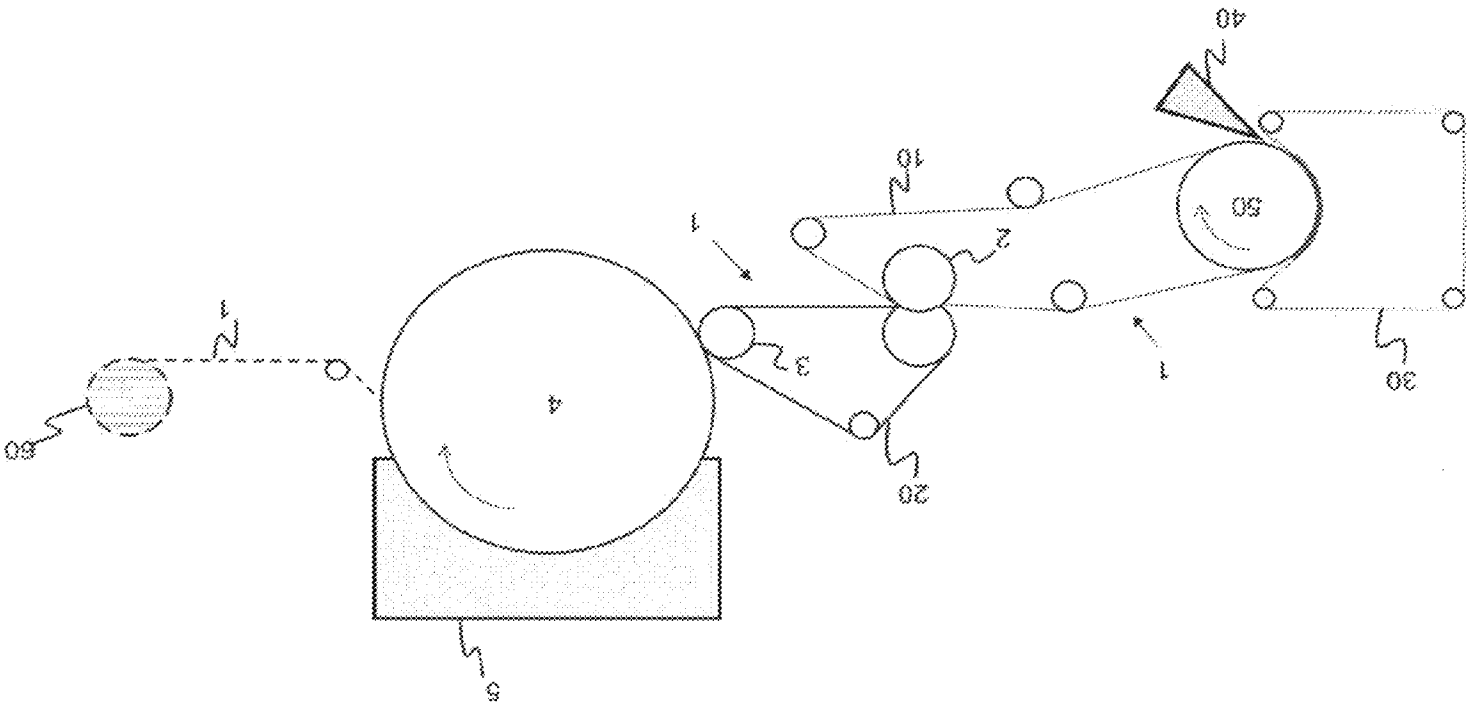
FIG. 2 shows by way of example a machine for producing a tissue web with a device according to a further aspect of the invention.

FIG. 2 shows, by way of example, a tissue machine with a device according to a further aspect of the invention, in particular with the device shown in FIG. 1.

From a headbox 40, the fibrous suspension is brought into a forming section, where the initial dewatering takes place. In this case, the formation of the fibrous web 1 takes place between the first felt 10 and a dewatering screen 30. Dewatering elements, such as a suction roll 50 or suction boxes (not shown in the figure), are usually provided here. The fibrous web 1 is then transported on the first felt 10 with a still relatively high moisture content to the first press 2. As described with regard to FIG. 1, the fibrous web 1 is further dewatered in the first press 2 by pressing between the first felt 10 and the second felt 20. When it leaves the press nip, the fibrous web 1 no longer continues to run with the first felt 10, but instead adheres to the second felt 20 and is transported onward from the latter to the Yankee cylinder 4. It can be advantageous here for a stable process if the paper-contacting side of the first felt 10 consists of a nonwoven layer which comprises at least 80 wt. % of nonwoven fibers which have a fineness of more than 6.7 dtex, in particular 11 dtex and more.

By means of a transfer press 3, the fibrous web 1 is transferred to the surface of the Yankee cylinder 4. Further drying of the fibrous web 1, that is to say in this case the tissue web 1, is performed by means of the usually steam-heated Yankee cylinder 4. In most cases, a hood 5 is provided, through which hot air is blown onto the tissue web 1. After the tissue web 1 has been removed from the Yankee cylinder 4—usually by means of crepe scrapers (not shown explicitly here)—the tissue web 1 is wound up with a reel 60 to form rolls, which can undergo further processing.

LIST OF REFERENCE SIGNS

1 fibrous web
2 first press
3 transfer press
4 Yankee cylinder
5 hood
10 first felt
20 second felt
30 dewatering screen
40 headbox
50 suction roll
60 reel

The invention claimed is:

1. A device for producing a fibrous web or tissue web, the device comprising:

a first press having a press nip, a first felt and a second felt, said first and second felts both being guided through said press nip of said first press;

a Yankee cylinder for drying the fibrous web;

a transfer press for transferring the fibrous web to said Yankee cylinder, said transfer press having a press nip, said second felt being guided through said press nip of said transfer press; and said second felt having an outermost paper-contacting side formed of a nonwoven layer including at least 80 wt. % of nonwoven fibers formed of polyamide or polyamides having a fineness of 3.3 dtex and less.

2. The device according to claim 1, wherein said nonwoven layer includes at least 90 wt. % of said nonwoven fibers formed of polyamide or polyamides.

3. The device according to claim 1, wherein said second felt also includes further nonwoven layers having nonwoven fibers, and at least 90 wt. % of said nonwoven fibers of all of said nonwoven layers have a fineness of 6.7 dtex and less.

4. The device according to claim 3, wherein at least 90 wt. % of said nonwoven fibers of all of said nonwoven layers have a fineness of 3.3 dtex or less.

5. The device according to claim 3, wherein at least some of said nonwoven fibers are materially bonded or adhesively bonded or welded or fused to one another in at least one of said nonwoven layers or in all of said nonwoven layers of said second felt.

6. The device according to claim 1, wherein said second felt has an air permeability of less than 5 cfm (approximately 142 l/min).

7. The device according to claim 6, wherein said air permeability of said second felt is 0 cfm.

8. The device according to claim 1, wherein said first felt has a paper-contacting side formed of a nonwoven layer including at least 80 wt. % of nonwoven fibers having a fineness of more than 6.7 dtex.

9. The device according to claim 8, wherein at least 80 wt. % of said nonwoven fibers of said nonwoven layer of said paper-contacting side of said first felt have a fineness of 11 dtex and more.

10. The device according to claim 1, wherein said first press is a shoe press.

11. A method for producing a fibrous web or a tissue web, the method comprising steps of:

transporting the fibrous web on a first felt to a first press;

pressing the fibrous web in the first press between the first felt and a second felt;

transporting the fibrous web with the second felt from the first press to a Yankee cylinder;

using a transfer press to transfer the fibrous web from the second felt to the Yankee cylinder;

guiding the second felt through a press nip of the transfer press; and providing an outermost paper-contacting side of the second felt formed of a nonwoven layer including at least 80 wt. % of nonwoven fibers formed of polyamide or polyamides and having a fineness of 3.3 dtex and less.

12. The method according to claim 11, which further comprises providing the nonwoven layer with at least 90 wt. % of the nonwoven fibers formed of polyamide or polyamides.

13. The method according to claim 11, which further comprises carrying out the pressing in the first press at more than 200 kN/m.

14. The method according to claim 13, which further comprises carrying out the pressing in the first press at between 400 kN/m and 600 kN/m.

* * * * *